US005565878A

United States Patent [19]

Lagerlöf

[11] Patent Number: 5,565,878

[45] Date of Patent: Oct. 15, 1996

[54] DISTRIBUTION NETWORK

[75] Inventor: Rolf O. E. Lagerlöf, Mölnlycke, Sweden

[73] Assignee: Telefonaktiebolaget LM Ericsson, Stockholm, Sweden

[21] Appl. No.: 421,981

[22] Filed: Apr. 14, 1995

[30] Foreign Application Priority Data

Apr. 15, 1994 [SE] Sweden ..... 9401281

[51] Int. Cl.[6] ..... H01Q 13/00

[52] U.S. Cl. ..... 343/778; 343/776; 343/853

[58] Field of Search ..... 343/778, 853, 343/776, 772, 777; H01Q 13/00

[56] References Cited

U.S. PATENT DOCUMENTS

| | | | |
|---|---|---|---|
| 3,218,580 | 11/1965 | Zanichkowsky | 343/778 |
| 3,438,040 | 4/1969 | Radford | 343/778 |
| 3,553,692 | 1/1971 | Drabowitch | 343/778 |
| 3,754,272 | 8/1973 | Goldstone et al. | 343/778 |
| 3,977,006 | 8/1976 | Miersch | 343/778 |

FOREIGN PATENT DOCUMENTS 1406674A 6/1988 U.S.S.R. .

*Primary Examiner*—Hoanganh Le
*Attorney, Agent, or Firm*—Burns, Doane, Swecker & Mathis, L.L.P.

[57] ABSTRACT

A device for distributing a microwave signal in an array antenna to a number of radiating elements includes a main branching point at which the microwave signal is distributed to a first and a second antenna section. Each antenna section has a number of branching points connected in series, each of which distributes the microwave signal supplied to the branching point between a waveguide, connected to the branching point, and the next branching point connected in series. A number of parallel branches are connected to the waveguide. These parallel branches distribute the microwave signal supplied through the waveguide between the radiating elements.

7 Claims, 1 Drawing Sheet

DISTRIBUTION NETWORK

BACKGROUND

The present invention relates to a device for distributing a microwave signal between the radiating elements of an array antenna.

For feeding array antennas with frequencies within the microwave range, different networks usually, for example, make use of stripline technology or waveguides. The requirements of the networks are to give a constant feed to the radiating elements of the antenna within the used frequency band, both with regard to amplitude as well as to phase. This is important to insure that the desired radiating characteristics are obtained. Particularly low sidelobe levels put high demands on the accuracy of the feed. Additional demands on the network are to manage occurring power levels and to allow a sufficiently compact placement of the outputs of the network, which is determined by the separation of the radiating elements which is usually of the order of 0.5–0.7 wavelengths.

A complicating factor in this context is that the radiating elements show a varying impedance when the frequency and radiating direction are changed. The latter can for example be controlled by a phase changer. In cases like the present one it is usual to speak of the "active impedance" of the elements which consequently change during operation. In spite of this, it is required that the feed of the elements can be done so that the excitation becomes the intended one (prescribed amplitude, usually linearly changing phase) in spite of the mentioned load variations.

A common type of antenna has vertical electrical lobe control, but a sideways fixed lobe. Such an antenna has two sets of feed networks, a plurality (often alike) for the feeding of every horizontal row of the antenna, as well as one with built in variable phase changers that feed the individual rows vertically. It is especially important in these cases to obtain low weight and low manufacturing costs for the fixed horizontal networks, as these occur in a great number in each antenna.

Such compact feeding networks are feasible in stripline technology. This, however, gives several disadvantages, such as high losses and poor power sustainability. A better technology from many points of view is to use feeding networks realized with waveguides.

In order to i.a. be able to attain a satisfactory bandwidth, it is essential that the electrical length from the feeding point of the antenna to each radiating element is the same. This can easily be attained with a waveguide network that is constructed as repeating parallel junctions. Such a network does however acquire large dimensions and an extreme weight, which often cannot be accepted.

Another waveguide solution can be based on serial feeding, which gives smaller dimensions, but usually an unwanted frequency-dependent lobe direction.

To be able to cope with the load variations from the radiating elements, it might be necessary to use branching components (power divider) of the four port type. The fourth port is terminated and used for absorbing possible imbalances of the reflections from the load. Possible components are the magic T, 90° hybrids etc. These are however mostly all too bulky, and they also increase the costs.

Different serial feed array antennas are known. The American patent U.S. Pat. No. 3,438,040 is an example of a device where the radiating elements of an array antenna are serially fed. The power division would seem to be done by means of variation of the waveguide dimensions. This solution of the problem is however less suitable since the power division should be done in the magnetic plane, because a change of the waveguide width will influence both the waveguide wavelength and as well as the impedance.

The American patent U.S. Pat. No. 3,977,006 also describes a serially fed array antenna. In this, the power is distributed by means of slots in a feed waveguide, whereby each slot feeds a waveguide connected to a radiating element. Due to the polarization rotation in the slots, the fed waveguides have to be placed 90° rotated in relation to the feeding waveguide, an arrangement that becomes bulky, especially "vertically". Because the characteristics of the slots are frequency dependent, the device will furthermore have a proportionately narrow bandwidth.

SUMMARY

An object of the present invention is therefore to realize in an array antenna a cheap, power sustainable feeding network with a low weight, that feeds radiating elements along a row of radiating elements in an array antenna in phase according to a precisely prescribed amplitude distribution, to thereby obtain very good side lobe characteristics and low losses.

Another object of the present invention is to integrate the radiating elements into the feeding network.

Still another object of the present invention is to minimize the number of terminations and other additional components in the network, so that all functions can be attained by a structure that can easily be manufactured with as few loose parts as possible.

Said objects are attained by means of a feeding network that combines series and parallel feeding and where the power division is done in the magnetic plane. Accordingly, the network is constituted by a number of branching points connected in series within which the supplied microwave signal is divided between a waveguide and the subsequent branching point. Each waveguide is connected to a parallel branch in which the microwave signal in the waveguide is divided to further parallel branches or directly to radiating elements. The lengths of the waveguides are chosen in such a way that the electrical length from the feeding point of the network to the parallel branches is the same, whereby the demand for a cophasal feed of the radiating elements is fulfilled.

By the combination of series and parallel feed, a network is attained that can be constructed compactly with regard to depth (distance between the connection point of the array antenna and the radiating elements) at the same time that the division in the magnetic plane means the height of the network can be kept low.

The feeding network is further constructed in such a way that it can, for example, be constructed from a small number of parts, for example by means of milling branching points, waveguides, and radiating elements from a block of metal that is then sealed with a cover.

DETAILED DESCRIPTION

Figure 1:
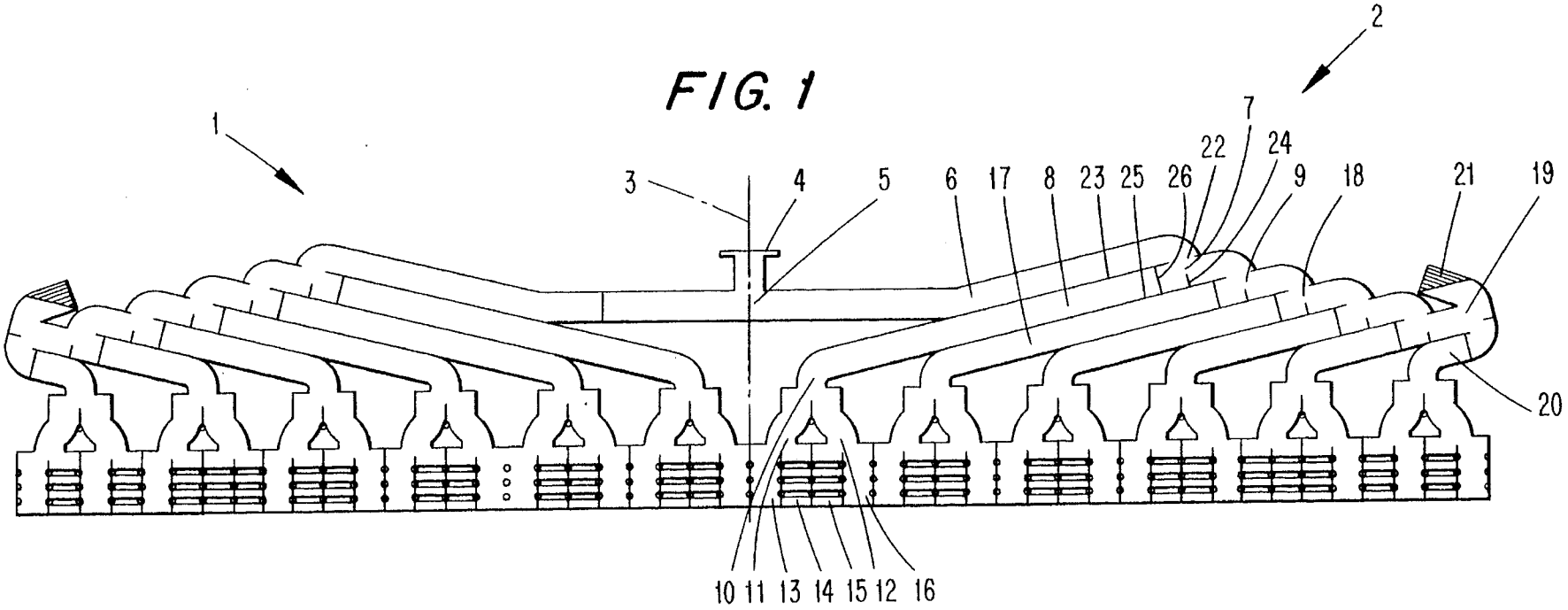
FIG. 1 shows a part of an array antenna with a feeding network according to the invention.

With reference to FIG. 1, the invention will now be described in the form of an exemplary embodiment.

FIG. 1 shows a part of an array antenna with a possible embodiment of a power splitting feeding network according to the invention. The feeding network can be composed of waveguides that are milled in the form of canals out of a metal block, for example aluminium. The complete network is obtained after a plane cover is mounted onto the canal part and is joined together with this by means of, for example, salt bath soldering.

In the shown example the "depth" of the canals is less than their width. The "depth" corresponds to the height in those waveguides that are formed when the plane cover is mounted. The power division will consequently be performed in the magnetic plane (H-plane) of the waveguides.

The shown part of the array antenna is made of two parts, 1 and 2, that are mirror symmetrical with respect to the division line 3. The common connection point 4 of the antenna is placed on the division line 3. The signal supplied from an external signal source to the connection point 4 is distributed in a main junction 5 between the two parts 1 and 2. One of the parts will be described below.

The signal is conducted from the main branching point 5 via a waveguide 6 to a second branching point 7. In this the signal is distributed between a waveguide 8 and a third branching point 9. The waveguide 8 leads to a splitting point or parallel junction 10 that distributes the signal in the waveguide between two further splitting points or parallel junctions 11 and 12 that distribute the signal to the four radiating elements 13–16.

In cases where the number of radiating elements is restricted, the further parallel junctions 11 and 12 can be left out and two radiating elements can instead be fed directly from the parallel junction 10.

In the third junction point 9, the supplied signal is also distributed between a waveguide 17 and a further junction point 18. Like the waveguide 8, the waveguide 17 leads to parallel junctions that distribute the signal in the waveguide to four other radiating elements just like the earlier mentioned junctions 10–12.

The described successive division among waveguides and series-connected junction points is repeated the necessary number of times so that all of the radiating elements are fed. In the last junction point, marked with 19 in the drawing, the signal is distributed between a waveguide 20 and a matched load 21 that prevents reflections from arising. The matched load 21 can however be constituted by a further waveguide that, in accordance with what has been described, is connected to parallel junctions and thereafter successive radiating elements.

All series-connected junction points (7, 9, 18, 19) are three ports (they are lacking a fourth port with termination). The function of the series-connected junction points is the same, for which reason only the second junction point 7 will be described in greater detail. In the junction point 7, the power in waveguide 6 is divided between waveguide 8 and the "next" junction point 9. The power is transferred from the waveguide 6 to the junction point 7 by means of a port 22 in the wall 23 which is common for the waveguides 6 and 8. The power division relationship is determined by the placement of a partition wall 24, placed in front of the port 22, perpendicular to the waveguide wall 25 which is opposite the port. The power division is influenced in such a way that if the partition wall 24 is displaced towards the junction point 9, less power will be supplied to it and more power is supplied to the waveguide 8. If the partition wall is displaced towards the waveguide 8, an opposite change of the division is obtained.

The asymmetric division results in certain small phase errors at the output of each junction point. This is however compensated for locally with fixed phase changers in the form of inductive and/or capacitive apertures 26 in the waveguides.

Each junction point is carefully optimized so that it exhibits a good adaptation to the outputs of the previous junction point. Optimization is done with modern analysis and method of calculation technology, that is also capable of handling the asymmetric division relationships that are part of the network.

The optimization also implies that the microwave signal that is supplied to the antenna can be distributed between the radiating elements with a high accuracy. The radiating characteristics of the antenna can therefore be adapted to different demands.

As waveguide technology is used for all parts of the feeding network, good power endurance and a good mechanical stability are attained.

The junction points and the waveguides are displaced and aimed in such a way that the outputs agree with the waveguide width, at the same time that the resulting electrical length from the connection point 4 to the outputs (radiating elements) can be made equally long for all the outputs, which means a cophasal feeding of the radiating elements and, accordingly, a large bandwidth.

The radiating elements are composed of the direct continuation of the parallel junctions, i.e. no extra components or connection devices are necessary. The active impedance of the elements is adapted to the outputs of the parallel junctions with an aperture that is integrated with the same structure as the feeding network.

Figure 2:
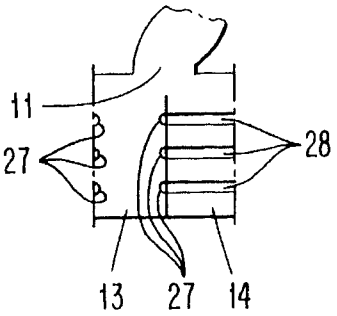
FIG. 2 shows details in a radiating element of an array antenna.

An example of this is depicted in FIG. 2 which shows the parallel junction 11 and the two radiating elements 13 and 14. In these, inductive and capacitive apertures 27, 28, respectively, are arranged on the waveguide walls.

By integration of the feeding network and the radiating elements in the same structure, and by means of a serial feed that does not put any demands on the distance between the junction points, it is possible to place the waveguides next to each other, whereby the geometric distance from the feeding point of the antenna to the openings of the radiating elements can be made short.

The possibility to divide the microwave signal in an accurate way between the radiating elements makes it possible to use the array antenna for mono pulse applications. If the main junction point 5 is replaced by a so called magic T, its difference port can be used during reception for forming the difference between the received signals of the two parts, 1 and 2, of the array antenna. The summation port of the magic T is in this case connected to the connection point 4 of the array antenna and both its "input" ports to the two antenna parts 1 and 2. Instead of a magic T, other devices can of course be used that form both their sum and their difference from two input signals.

In the described embodiment the power division is done in the H-plane of the waveguides. Nothing however prohibits that the network in a corresponding manner is constructed for power division in the E-plane.

The invention is not limited to the described embodiments, but may be varied within the scope of the appended claims.

What is claimed is:

1. A device for distributing a microwave signal in an array antenna in the magnetic plane to a number of radiating elements, the device comprising:

a main junction point in which the microwave signal is divided into a first antenna part and a second antenna part, the first and second antenna parts each comprising:

a number of series-connected junction points series-connected with each other and comprising at least a first series-connected junction point and a last series-connected junction point; wherein the first series-connected junction point is connected to the main junction point, each one of the series-connected junction points is connected to a previous junction point, a following junction point and a connecting waveguide which is separate for each one of the series-connected junction points; and each series-connected junction point is arranged to divide the microwave signal supplied from the previous junction point between the connecting waveguide and the following series-connected junction point;

a final junction point connected to the last series-connected junction point;

a number of splitting points, each of which is connected to its respective connecting waveguide, wherein the splitting points are arranged to divide the microwave signal supplied by the respective connecting waveguide between the radiating elements.

2. The device of claim 1, wherein the division of the microwave signal in the series-connected junction points, between each connecting waveguide and each following series-connected junction point is made in dependence upon a position of a partition wall placed on a waveguide wall opposite a port, through which the microwave signal is supplied to the junction point, and perpendicular to the waveguide wall.

3. The device of claim 1, wherein the final junction point that terminates the series-connected junction points divides the microwave signal supplied to the final junction point between a waveguide connected to the final junction point and a load provided to the final junction point.

4. The device of claim 1, wherein the final junction point that terminates the series-connected junction points divides the microwave signal supplied to the final junction point between a waveguide connected to the final junction point and a further waveguide connected to the final junction point said further waveguide in turn being connected to a parallel junction which is thereafter connected to radiating elements.

5. The device of claims 1, wherein the waveguides connected to the series-connected junction points are also each connected to their own respective parallel junction that divides the supplied microwave signal to further parallel junctions which in turn divide the microwave signal to the radiating elements.

6. The device of claim 1, wherein an electrical length from the main junction point of the array antenna to each radiating element is the same.

7. The device of claim 1, wherein the main junction point is constituted by a magic T.

* * * * *